US005332287A

United States Patent [19]

Whitmyer

[11] Patent Number: 5,332,287

[45] Date of Patent: Jul. 26, 1994

[54] ARTICULATING HEADREST

[75] Inventor: Jody J. Whitmyer, Tallahassee, Fla.

[73] Assignee: Whitmyer Biomechanix, Inc., Fla.

[21] Appl. No.: 894,441

[22] Filed: Jun. 5, 1992

[51] Int. Cl.[5] ..... A47C 7/36

[52] U.S. Cl. ..... 297/405; 297/408; 297/410

[58] Field of Search ..... 297/391, 397, 408, 409, 297/405, 410

[56] References Cited

U.S. PATENT DOCUMENTS

| | | | |
|---|---|---|---|
| 547,390 | 10/1895 | Akeley | 297/410 |
| 573,147 | 12/1896 | Higgins | 297/405 |
| 2,180,768 | 11/1939 | Peterson | 297/405 |
| 3,159,426 | 12/1964 | Kerr | 297/408 |
| 3,596,655 | 8/1971 | Corcoran | 297/391 X |
| 3,719,388 | 3/1973 | Fortnam | 297/405 |
| 3,730,589 | 5/1973 | Lane | 297/391 |
| 3,761,126 | 9/1973 | Mulholland | 257/391 X |
| 4,003,599 | 1/1977 | Takamatsu | 297/391 X |

*Primary Examiner*—Peter M. Cuomo
*Assistant Examiner*—Jerry Redman
*Attorney, Agent, or Firm*—Pettis & McDonald

[57] ABSTRACT

An articulating headrest of a type suitable for use in combination with a seating device. The headrest is comprised of an occipital pad and a pair of curvilinear sub-occipital pads, each of the pads being adjustably connected to the seating device by a support system such that at least a portion of the occipital pad engages at least a portion of the occiput region of the head of a person occupying the seating device and a first segment of each sub-occipital pad engages at least a portion of the sub-occiput region of the head of the person.

8 Claims, 3 Drawing Sheets

ARTICULATING HEADREST

BACKGROUND OF THE INVENTION

1. Field of the Inventions

The present invention relates to an articulating headrest of type that is suitable for use in combination with wheelchairs, medical and dental examination chairs, and similar devices that require support for a person's head.

2. Description of the Prior Art

Headrests that are formed as an integral part of a seating system and headrests that are separately attached to an existing seating system are well known in the art. Headrests formed as an integral part of a seat and extendable headrests with limited adjustment are well known in the automotive field. Single head-rests that are comprised of single pads and that are capable of limited height adjustments have been attached to wheelchairs to provide added support and comfort to wheelchair occupants. Head-rests formed from pairs of small, generally circular, pads can be seen attached to chairs used for medical, dental and eye examinations. These headrests are used for relatively short periods of time; therefore, the comfort of a person utilizing the headrest is often secondary to the requirement for relatively firm support. Neither the single pad nor the dual pads found in the prior art provide sufficient adjustability to support the different sized and shaped heads and necks found in the general population properly and comfortably. A particularly difficult problem exists for persons without full control or use of their neck muscles, for they are unable to obtain adequate support or comfort over the long term from the headrests existing in the prior art. It remains clear then, that there is a need for a more flexible headrest system that can provide longer term support and comfort for the persons utilizing them.

SUMMARY OF THE INVENTION

The present invention relates to an articulating headrest of a type suitable for use in combination with a seating device of the type that may include, but is not limited to, medical and dental examination chairs, wheelchairs and other devices for the physically disabled. The headrest is comprised of an occipital pad and a pair of curvilinear sub-occipital pads that are adjustably connected to the seating device so that the occipital pad engages at least a portion of the occiput region of the head of the person occupying the seating device, and a first segment of each sub-occipital pad engages at least a portion of the sub-occiput region of the head. Additional segments of the sub-occipital pad lie adjacent to other portions of the person's head to provide greater support as necessary. Each pad of the articulating headrest may be adjusted independently to provide the appropriate individualized support for the general population where persons have different sized and shaped heads.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings. The second embodiment of the invention illustrated in FIG. 7 utilizes reference numbers increased by an increment of 100.

DETAILED DESCRIPTION

Figure 1:
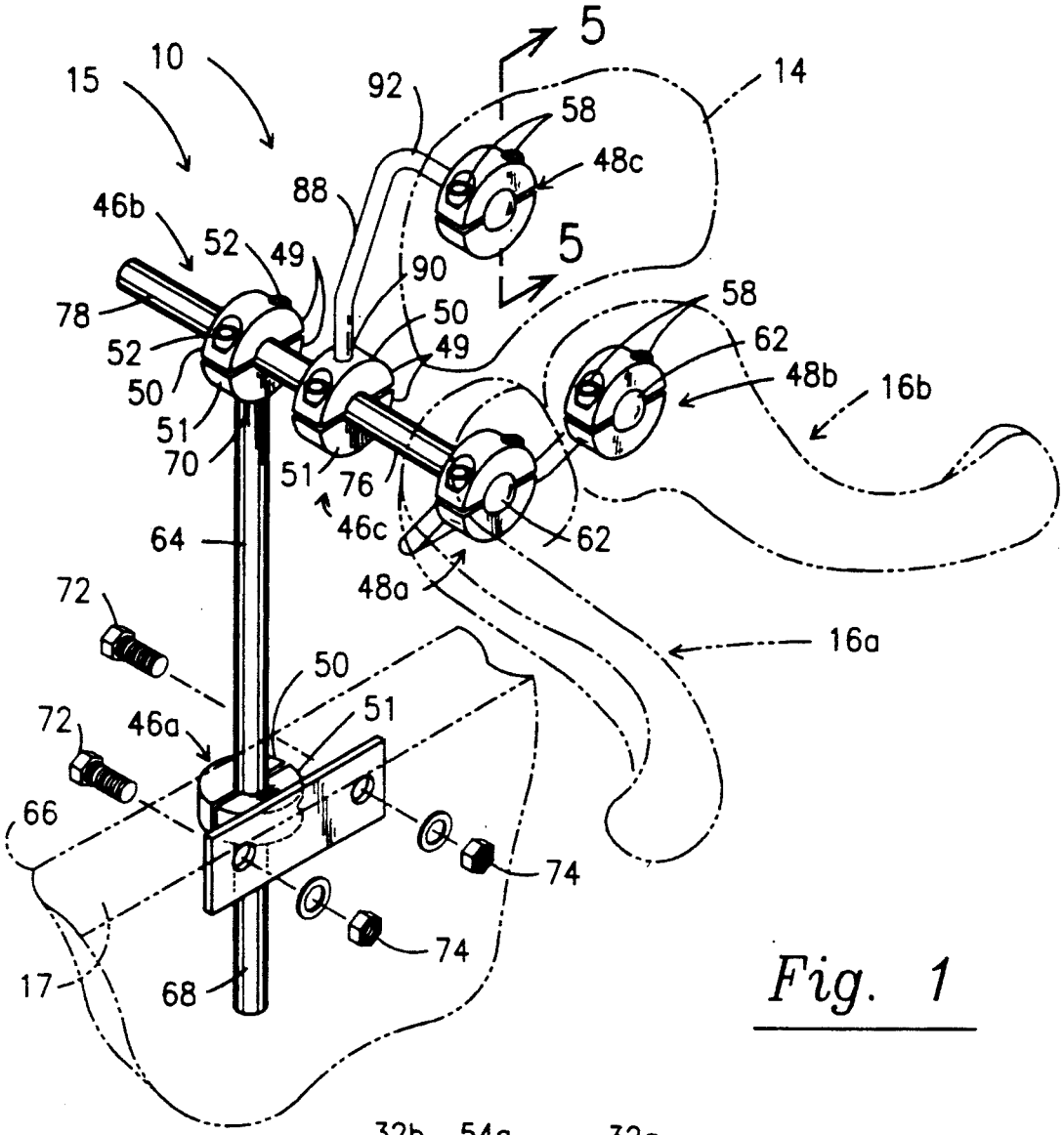
FIG. 1 is a perspective view of the headrest of this invention with the pads and seating device shown in phantom.
Figure 2:
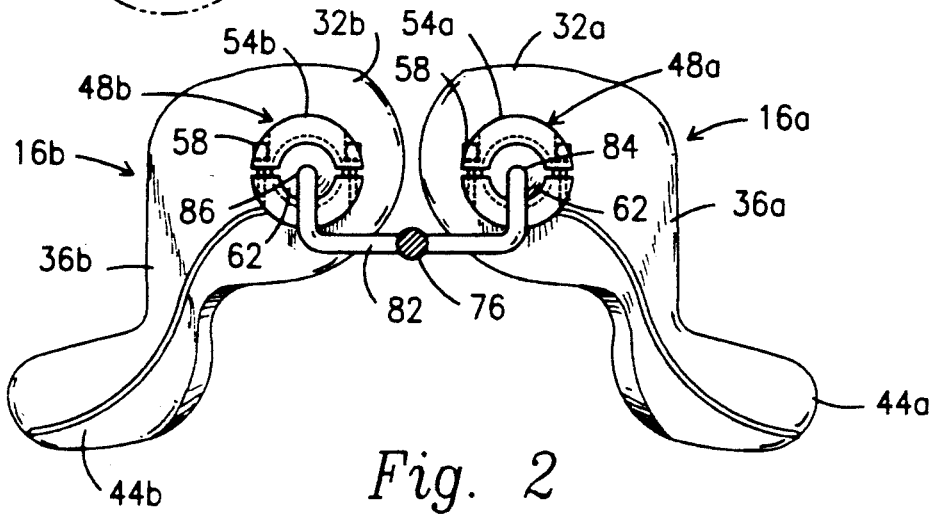
FIG. 2 is a rear view of a cross section of the headrest taken along line 2—2 of FIG. 3.
Figure 3:
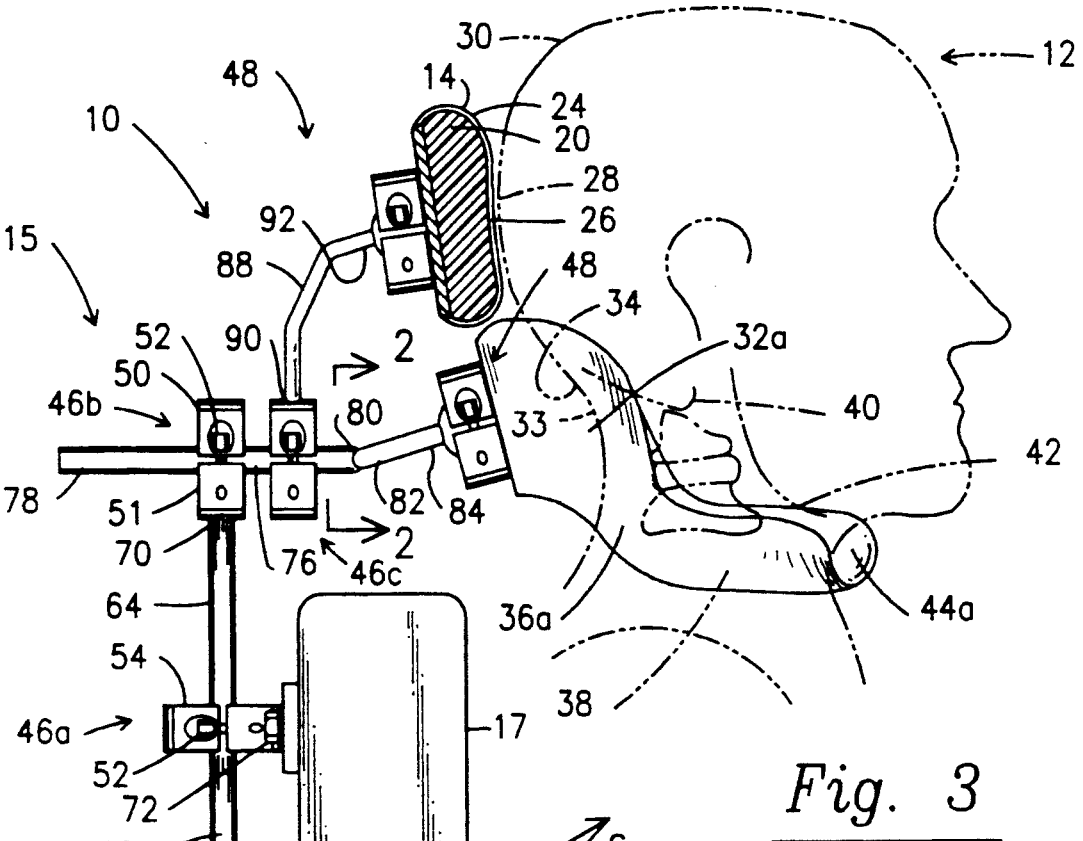
FIG. 3 is a right side elevation view of the headrest in partial cross section with a person shown in phantom.
Figure 4:
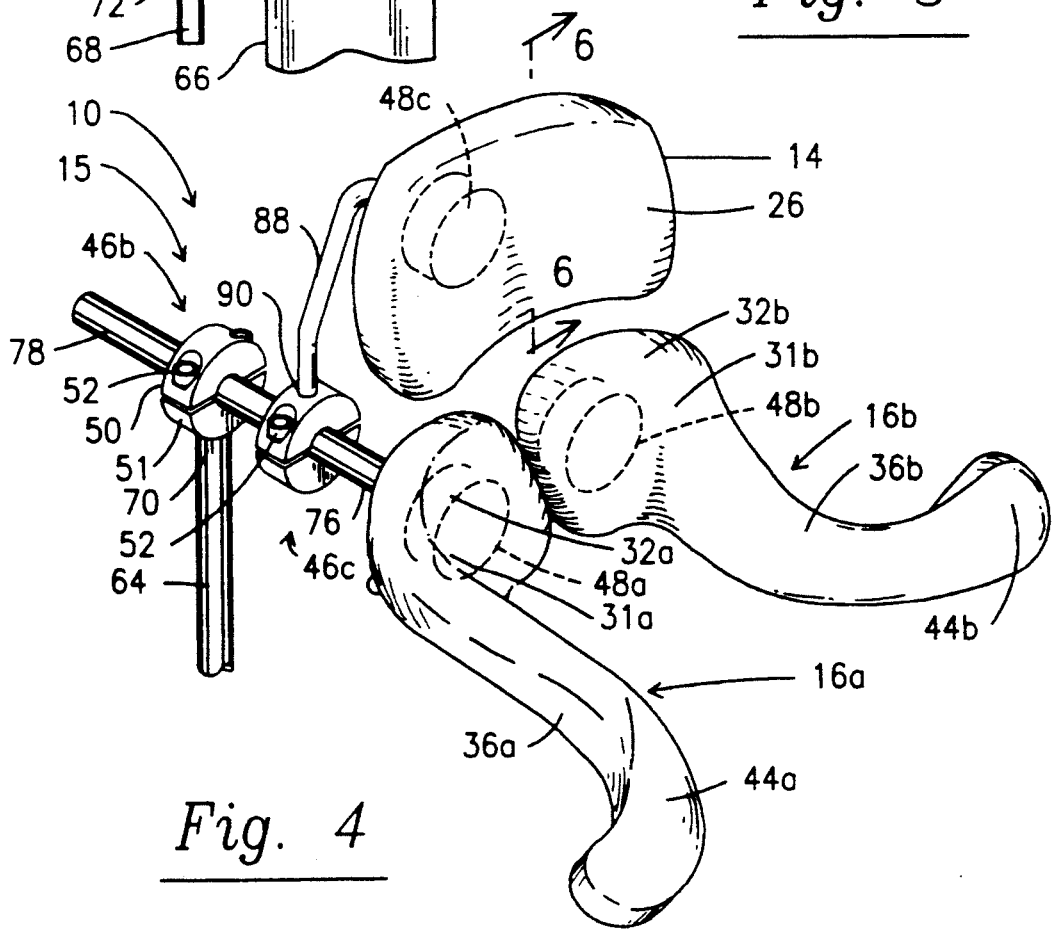
FIG. 4 is a perspective view of the headrest of this invention.

A preferred embodiment of the articulating headrest is illustrated in FIGS. 1–6 and is generally indicated as 10 in FIGS. 1 and 4. A person is shown in phantom and indicated generally as 12 in FIG. 3.

Figure 6:
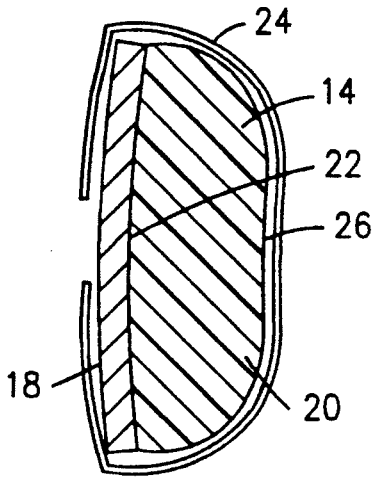
FIG. 6 is a cross sectional view taken along 6—6 of FIG. 4.

The headrest 10 is comprised of an occipital pad 14, a pair of sub-occipital pads, shown generally as 16*a* and 16*b*, and a support system, shown generally as 15, that provides for attachment of the pads to a seating device 17, which may be a wheelchair, medical examination chair, dental chair or any personal support system that requires support for the head. As shown in FIG. 6, each of the pads is comprised of a plate 18, padding 20, which is disposed on a side 22 of the plate 18, and a cover means 24 that substantially covers the padding 20 and plate 18. The plate 22 may be made from metal, plastic or any other suitable material. The padding 20 may be made from foam rubber, foe made from a synthetic resin or any other suitable material. The cover 24 may be comprised preferably of a soft, absorbent cloth; however, any woven fabric, leather, vinyl or other similar material may be used. In the preferred embodiment, the padding 20, used to construct the occipital pad 14 and the sub-occipital pads 16*a* and 16*b*, is rounded along its edges, as seen in FIG. 6, to provide a softened contour for increased comfort and a more flexible fit to the contours of the person 12. In the preferred embodiment a zipper (not shown) is positioned adjacent to the side of plate 18 opposed to the padding 16 as a means for opening and closing the individual covers to enable their removal for cleaning. Other suitable fastening means may be used including, but not limited to, snaps and hook and loop fasteners.

The side 26 of the occipital pad 14 that contacts the person 12 is generally concave in order to engage at least a portion of the occiput region 28 of the head 30. The occiput region 28 is defined as the back part of the skull. Sub-occipital pads 16*a* and 16*b* are each curvilinear and a mirror image of one another so that the pads may bracket the head 30, and independently conform generally with the shape of the adjacent portions of the head 30. In the preferred embodiment, each of the sub-occipital pads are comprised of three segments. Sides 31*a* and 31*b* of the respective first segments 32*a* and 32*b* are generally concave so that sides 31*a* and 31*b* will engage at least a portion of the sub-occipital region 33. The occipital region 34 is defined as near the occipital bone, the compound bone that forms the posterior part of the skull, which is below the occiput region 28. Therefore, the sub-occipital region 33 is defined as the area of the head adjoining and below the occipital region 34. The sub-occipital pads 16*a* and 16*b* are generally longitudinal, and the second segments 36*a* and 36*b* are contiguous with and extend longitudinally from their respective first segments 32*a* and 32*b*. The second segments 36*a* and 36*b* extend forward while at the same time curving downward as can best be seen in FIG. 3. The curvature of the second segment 36*a* permits this segment to lie adjacent to the lateral cervical area 38 while curving below the mastold process area 40. The lateral cervical area 38 is defined as the side portion of the neck, that is, the portion of the neck below each ear and the mastoid process area 40 is defined as the process of the temporal bone located behind and slightly below the ear of a person. Second segment 36*a* then extends forward generally horizontally and adjacent to the mandible area 42. The mandible area 42 is defined as the lower jaw of a person. Segment 36*b*, being a mirror image of second segment 36*a*, relates to the lateral cervical area, mastold process area, and mandible area on the left side of the person's head 30 in the same manner, though it is not shown. The third segments 44*a* and 44*b* are contiguous with and extend generally longitudinally from their respective second segments 36*a* and 36*b*. The third segments 44*a* and *b* extend generally horizontally but flare outwardly in relation to the head 30 of the person 12.

Figure 5:
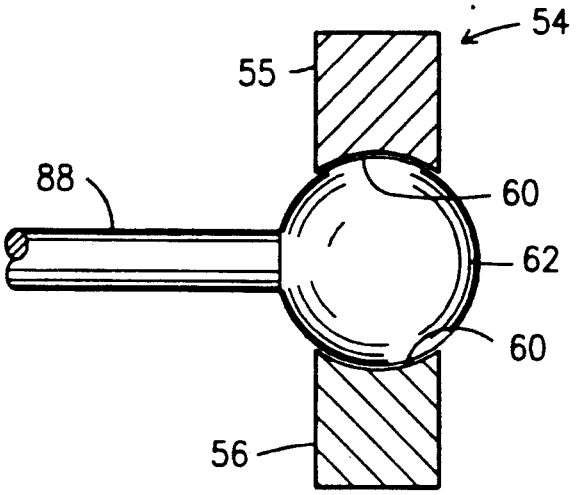
FIG. 5 is an enlarged cross sectional view taken along 5—5 of FIG. 1.

The support system 15 for attaching the headrest 10 to the seating device 17 is comprised of releasable connectors 46 and pivotal connectors 48. In the preferred embodiment, the releasable connector 46 comprises a sleeve 49 split longitudinally into two generally equal portions 50 and 51 as shown in FIG. 1. These portions 50 and 51 are joined by an attaching means, conveniently a pair of screws 52, that pass through portion 50 and are threaded to portion 51. In the preferred embodiment, the pivotal connector 48 is comprised of a ball and socket joint as illustrated in FIGS. 1, 2 and 5. Each socket is comprised of an annular ring 54 that is split into generally equal parts 55 and 56 that are attached to one another by a fastening means, conveniently a pair of screws 58, which pass through part 55 and are threaded to part 56. The interior surface 60 of the annular ring 54 is curved to receive the ball 62 forming the ball and socket joint of pivotal connector 48.

The support system 15 further comprises a support member 64 which, in the preferred embodiment, is movably attached by releasable connector 46*a* to the back 66 of the seating device 17. The releasable connector 46*a* may be attached by any conventional means, which in the preferred embodiment is shown to be nuts 72 and bolts 74, but it may also be attached by welding or other conventional means. The releasable connector 46*a* is attached so that when it receives support member 64, the support member 64 will be oriented generally vertically. The support member 64 has a first end 68 and a second end 70. The second end 70 of the support member 64 may be extended and positioned above the back 66 of the seating device 17 and held in the desired position by tightening the screws 52, clamping the sleeve 49 to the support member 64. A releasable connector 46*b* is attached to the second end 70 of the support member 64 and is positioned so that when it receives the sub-occipital support shaft 76, the shaft 76 will be generally horizontally oriented.

The sub-occipital support shaft 76 has a first end 78 and a second end 80. The second end 80 of the shaft 76 is attached to the mid portion of a "U"-shaped element 82 that has a first end 84 and a second end 86. Each end 84 and 86 of element 82 has a ball 62 attached thereon. The first segments 32*a* and 32*b* of each respective sub-occipital pad 16*a* and 16*b* have a respective pivotal connector 48*a* and 48*b* attached to the plate 18 of each pad 16*a* and 16*b*. The balls 62 are received by their respective annular rings 54 to form two pivotal connectors 48, one for each sub-occipital pad 16*a* and 16*b*. The sub-occipital pads 16*a* and 16*b* are separate pads that independently pivot about their respective pivotal connectors 48*a* and 48*b* so that each pad may be independently positioned adjacent to and generally parallel with the adjacent portion of the sub-occiput area 34 of the person 12, and at the same time adjacent to and generally parallel with the lateral cervical area 38 of the person 12. The sub-occipital pads 16*a* and 16*b* may be held in position by tightening screws 58.

An occipital support rod 88 having a first end 90 and a second end 92 is mounted to the sub-occipital support shaft 76. The first end 90 of the support rod 88 is attached to releasable connector 46*c* which is mounted in the preferred embodiment to the support shaft 76 intermediate releasable connector 46*b* and second end 80 of the support shaft 76. If required to obtain a proper fit, releasable connector 46*c* may be mounted intermediate releasable connector 46*b* and first end 78 of the sub-occipital support shaft 76. The second end 92 of the support rod 88 has a ball 62 attached thereon which is received by annular ring 54*c* that is attached to plate 18 of the occipital pad 14, creating pivotal connector 48*c*.

Figure 7:
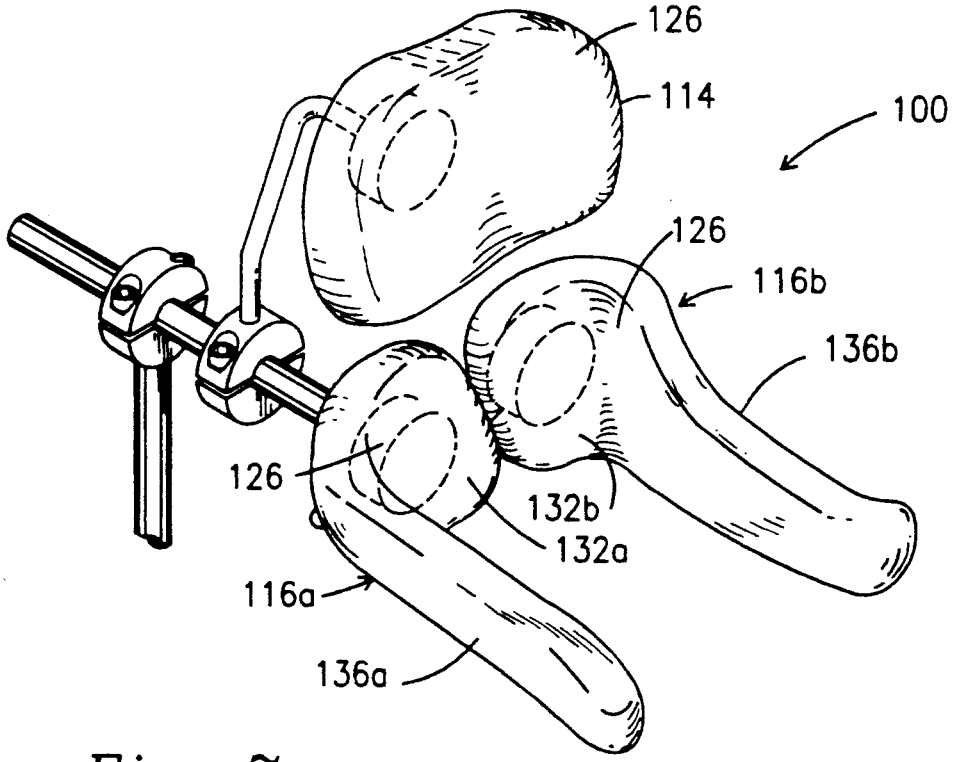
FIG. 7 is a perspective view of the invention illustrating a second embodiment of the sub-occipital pads.

FIG. 7 illustrates a second embodiment of the headrest 10 which is indicated generally as 100. This embodiment is the same as the emdbodiment identified as 10, except that the sub-occipital pads 116*a* and 116*b* are comprised of only two segments, first segments 132*a* and 132*b* and second segments 136*a* and 136*b*, the third flaring segment 44*a* and 44*b*, as shown in FIG. 4, is not incorporated in this second embodiment.

Having thus set forth a preferred construction for the articulating headrest 10 of this invention, it is to be remembered that this is but a preferred embodiment. Attention is now invited to a description of the use of the articulating headrest 10. Before the headrest 10 may be used, it must assembled as shown in FIG. 1 and discussed previously, and it must be attached to a solid back of a seating device 17.

The headrest 10 is positioned in the approximate location before person 12 occupies the seating device. The occipital pad 14 is moved rearward so that the occipital pad 14 will not touch the person's head 30. The person 12 is then seated within the seating device 17. As best illustrated in FIG. 3, the following steps are taken to ensure proper adjustment of the headrest 10. Before each adjustment, the screws of the appropriate releasable 46 and pivotal 48 connectors are loosened, and after each adjustment, the screws of the connector are tightened to hold the connector in the selected positions. The support member 64 is raised until the sub-occipital pads 16*a* and 16*b* are at the approximate height of the person's 12 sub-occipital area 34. The sub-occipital support shaft 76 is moved forward until the first segments 32*a* and 32*b* of the sub-occipital pads 16*a* and 16*b* make contact with the person's sub-occiput area 34. Next, the sub-occipital pads 16*a* and 16*b* are rotated about their respective pivotal connectors 48*a* and 48*b* until the greatest amount of contact is made with the sub-occipital area 34 of the person 12. These adjustment steps are repeated until the person is comfortable. Once the sub-occipital pads 16*a* and 16*b* have been adjusted, the occipital pad 14 is moved forward on the sub-occipital support shaft until the occipital pad 14 makes contact with the person's occiput area 28. The occipital pad 14 is then rotated about pivotal connector 48*c* until the greatest area of the occipital pad makes contact with the occiput area 28. The sub-occipital pads must be checked to ensure that they adequately clear the mastoid process area 40 and only make light contact with the lateral cervical area 38 and mandible area 42. Once all the adjustments are made, all the screws should be securely tightened to securely hold the headrest in proper position.

It will thus be seen that the objects set forth above, among those made apparent from the preceding description, are efficiently obtained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described,

What is claimed is:

1. An articulating headrest of a type suitable for use in combination with a seating device for a person wherein said headrest comprises:

an occipital pad and a pair of curvilinear sub-occipital pads, each of said pads being adjustably connected to the seating device, said occipital pad and said sub-occipital pads being adjacent to one another and at least a portion of each said sub-occipital pad being located generally directly below said occipital pad, such that at least a portion of said occipital pad is adapted for engagement with at least a portion of an occiput region of a head of a person occupying the seating device, and each sub-occipital pad of said pair of sub-occipital pads comprising a first segment and a second segment wherein said first segment is adapted for engagement with at least a portion of a sub-occipital region of the head of the person and said second segment extending forwardly of said first segment.

2. The headrest as in claim 1 wherein each said sub-occipital pad is generally longitudinal and is comprised of a plurality of curvilinear, contiguous, longitudinal segments, each of second segments of said sub-occipital pads curving downwardly from said first segment such that said second segment, in relation to the head of the person occupying the seating device, is positioned substantially adjacent to a lateral cervical area, but curves below a mastoid process area and then extends forward generally adjacent to a mandible area.

3. The headrest as in claim 2 wherein each said sub-occipital pad comprises a third segment extending generally horizontally from said second sediment and flaring outwardly in relation to the head of the person occupying the seating device.

4. The headrest as in claim 1 further comprising;

a headrest support member having a first end and a second end, said first end being movably attached to the seating device, said second end being extendable above the back of the seating device and having a releasable connector attached thereon, a sub-occipital support shaft having a first end and a second end, said first end of said shaft being received by said releasable connector attached to said second end of said support member such that said support shaft is movably attached to said support member, and said second end of said shaft being attached to a "U"-shaped element having a first end and a second end, said first end of said "U"-shaped element and said second end of said "U"-shaped element each being attached by a pivotal connector to a corresponding one of said sub-occipital pads; and an occipital support rod having a first end and a second end, said first end of said rod being movably mounted to said support shaft by a releasable connector, said second end of said support rod being attached by a pivotal connector to said occipital pad.

5. The headrest as in claim 4 wherein said releasable connectors each comprise a sleeve split longitudinally into two generally equal portions, said portions Joined by an attaching means such that by tightening said attaching means said releasable connectors may be releasably attached to said support member and said support shaft.

6. The headrest as in claim 4 wherein said pivoting connector comprises a ball and socket, one said ball being attached to said first end of said "U"-shaped element, one said ball being attached to said second end of said "U"-shaped element and one ball being attached to said second end of said support rod, one said socket being attached to each said sub-occipital pad and to said occipital pad, each said socket receiving a respective said ball forming said pivoting connector, and a means for locking each said adjustable pivoting connector in position.

7. The headrest as in claim 1 wherein said occipital and sub-occipital pads each comprise a plate, padding disposed on a side of said plate and a cover means substantially covering said padding and said plate.

8. The headrest as in claim 7 wherein said cover means is removable.

* * * * *

UNITED STATES PATENT AND TRADEMARK OFFICE

CERTIFICATE OF CORRECTION

PATENT NO. : 5,332,287

DATED : July 26, 1994

INVENTOR(S) : Jody J. Whitmyer

It is certified that error appears in the above-identified patent and that said Letters Patent is hereby corrected as shown below:

Column 5, line 52, after "person" insert --,--.

Column 5, line 57, after the first occurrence of "of" insert --said--; and

Column 6, line 7, delete "sediment" and insert therefor --segment--.

Signed and Sealed this

Fifteenth Day of November, 1994

*Attest:*

*Attesting Officer*

Bruce Lehman

BRUCE LEHMAN

*Commissioner of Patents and Trademarks*